US010307665B2

(12) United States Patent
Chu et al.

(10) Patent No.: US 10,307,665 B2
(45) **Date of Patent: *Jun. 4, 2019**

(54) MULTIPLY INTERACTIVE GAME EQUIPMENT

(71) Applicant: En-Shin Chu, Taichung (TW)

(72) Inventors: En-Shin Chu, Taichung (TW); Yu-Tsen Huang, Taichung (TW); Kuan-Wei Huang, Taichung (TW)

( * ) Notice: Subject to any disclaimer, the term of this patent is extended or adjusted under 35 U.S.C. 154(b) by 134 days.

This patent is subject to a terminal disclaimer.

(21) Appl. No.: 15/464,244

(22) Filed: Mar. 20, 2017

(65) Prior Publication Data

US 2018/0264353 A1 Sep. 20, 2018

(51) Int. Cl.
*A63F 9/30* (2006.01)
*A63F 9/24* (2006.01)

(52) U.S. Cl.
CPC ..... *A63F 9/30* (2013.01); *A63F 2009/2489* (2013.01)

(58) Field of Classification Search
CPC ..... A63F 9/30; A63F 9/24; A63F 2009/2442
USPC ..... 273/447
See application file for complete search history.

(56) References Cited

U.S. PATENT DOCUMENTS 8,079,596 B1 * 12/2011 Shoemaker, Jr. ... G07F 17/3297 273/447
2004/0048659 A1 * 3/2004 Seelig ..... A63F 9/30 463/25
2006/0170164 A1 * 8/2006 Watanabe ..... A63F 9/30 273/447
2009/0191931 A1 * 7/2009 Peck ..... G07F 17/32 463/7
2010/0090408 A1 * 4/2010 Fukazawa ..... A63F 9/30 273/447

* cited by examiner

*Primary Examiner* — Allen Chan

(57) ABSTRACT

A game machine includes an object-capturing unit, a maneuver unit and a display unit. The game machine includes a capture area for containing objects each provided with an RFID tag and a scan area in communication with the capture area. The maneuver unit is operable to control the object-capturing unit to capture one of the objects from the capture area and drop the object into the scan area. A control module includes a processing unit, an initiating unit and a tag scanner. The processing unit is electrically connected to the object-capturing unit, the maneuver unit and the display unit. The initiating unit is electrically connected to the processing unit. The tag scanner is electrically connected to the processing unit, and adapted for scanning the RFID tag of the object so that a code of the RFID tag of the object can be translated and shown on the display unit.

10 Claims, 4 Drawing Sheets

MULTIPLY INTERACTIVE GAME EQUIPMENT

BACKGROUND OF INVENTION

1. Field of Invention

The present invention relates to game machines and, more particularly, to multiply interactive game equipment operable to search for certain combinations to accomplish missions.

2. Related Prior Art

People are under heavier and heavier pressure because people have less and less time and space to exercise to release stress. Some people come to video games for entertainment to release stress and improve health. A game machine like a doll-clipping machine is a common choice for such entertainment. Such a game machine includes a space for containing products such as fluffy dolls and electronic products and a maneuver device operable to instruct a product-capturing device to capture one of the products and then drop the product onto a chute which in turn sends the product to a player standing in front of the game machine. Such maneuver is fun and entertaining.

However, such a game machine shows all of the products to people. It is not attractive if the products are cheap. It is attractive if the products are expensive. In the second case, an owner of the game machine is forced to reduce the odds to make an adequate profit from the game machine. Such low odds will drive people away from the game machine in the long run. Moreover, such a game machine is operated as a stand-alone machine that cannot be connected to a remote server. The ways of operating such a game machine are limited, and so is the fun the player can get from operating it. Furthermore, such a game machine cannot be used for desirable advertisement or marketing.

SUMMARY OF INVENTION

It is an objective of the present invention to provide multiply interactive game equipment for providing a new manner of playing games to increase entertaining effects.

It is another objective of the present invention to provide multiply interactive game equipment for allowing a player to search for certain targets to complete a mission in a game, thereby providing multiple effects of game.

To achieve the foregoing objectives, the multiply interactive game equipment includes a game machine and a control module. The game machine includes a space, an object-capturing unit, a maneuver unit and a display unit. The space includes a capture area and a scan area. The capture area contains objects each provided with an RFID tag. The scan area is in communication with the capture area. The object-capturing unit is located in an upper portion of the space of the game machine. The maneuver unit is supported on the game machine and operable to control the object-capturing unit to capture one of the objects from the capture area and then drop the object into the scan area. The display unit is supported on the game machine. The control module is located in the game machine and includes a processing unit, an initiating unit and a tag scanner. The processing unit is electrically connected to the object-capturing unit, the maneuver unit and the display unit. The initiating unit is electrically connected to the processing unit. The tag scanner is electrically connected to the processing unit, located in the scan area of the game machine, and adapted for scanning the RFID tag of the object so that a code of the RFID tag of the object can be translated and shown on the display unit.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
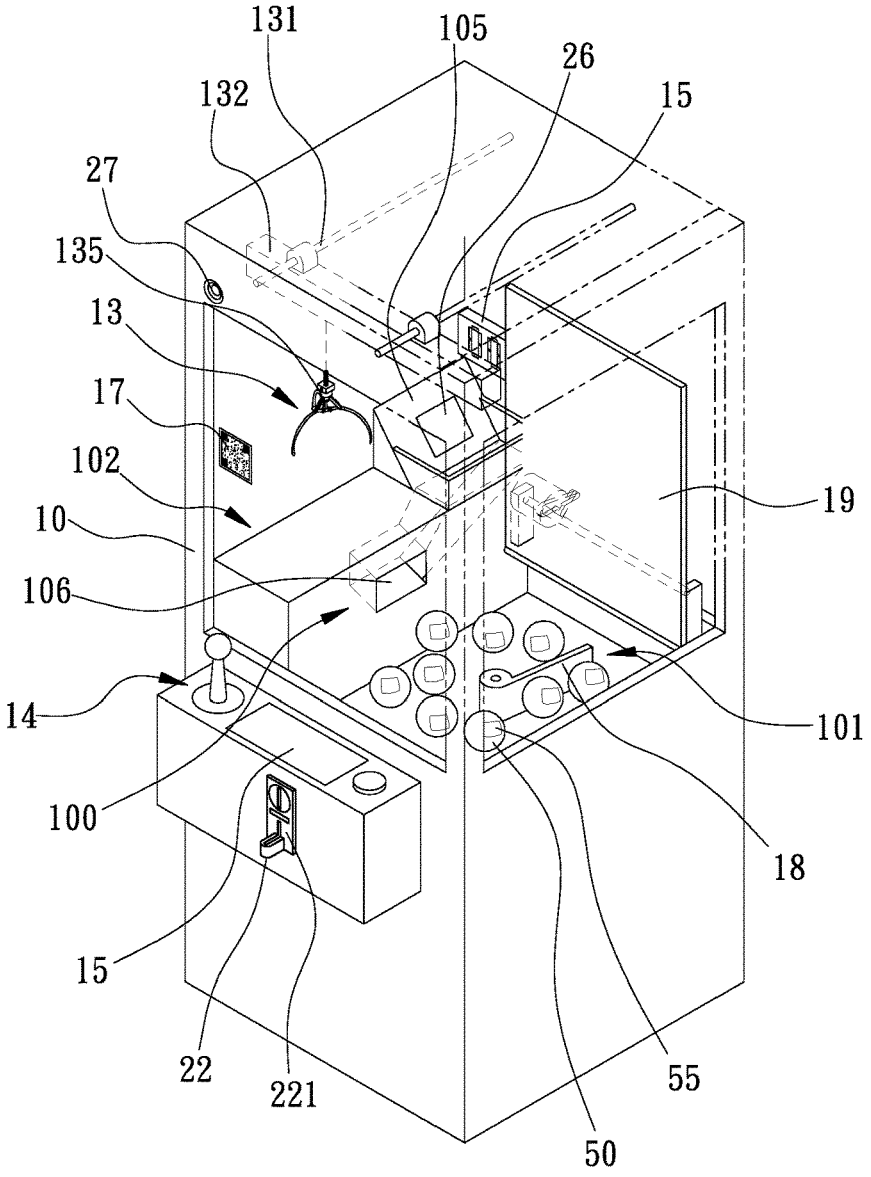
FIG. 1 is a perspective view of multiply interactive game equipment according to the preferred embodiment of the present invention.
Figure 2:
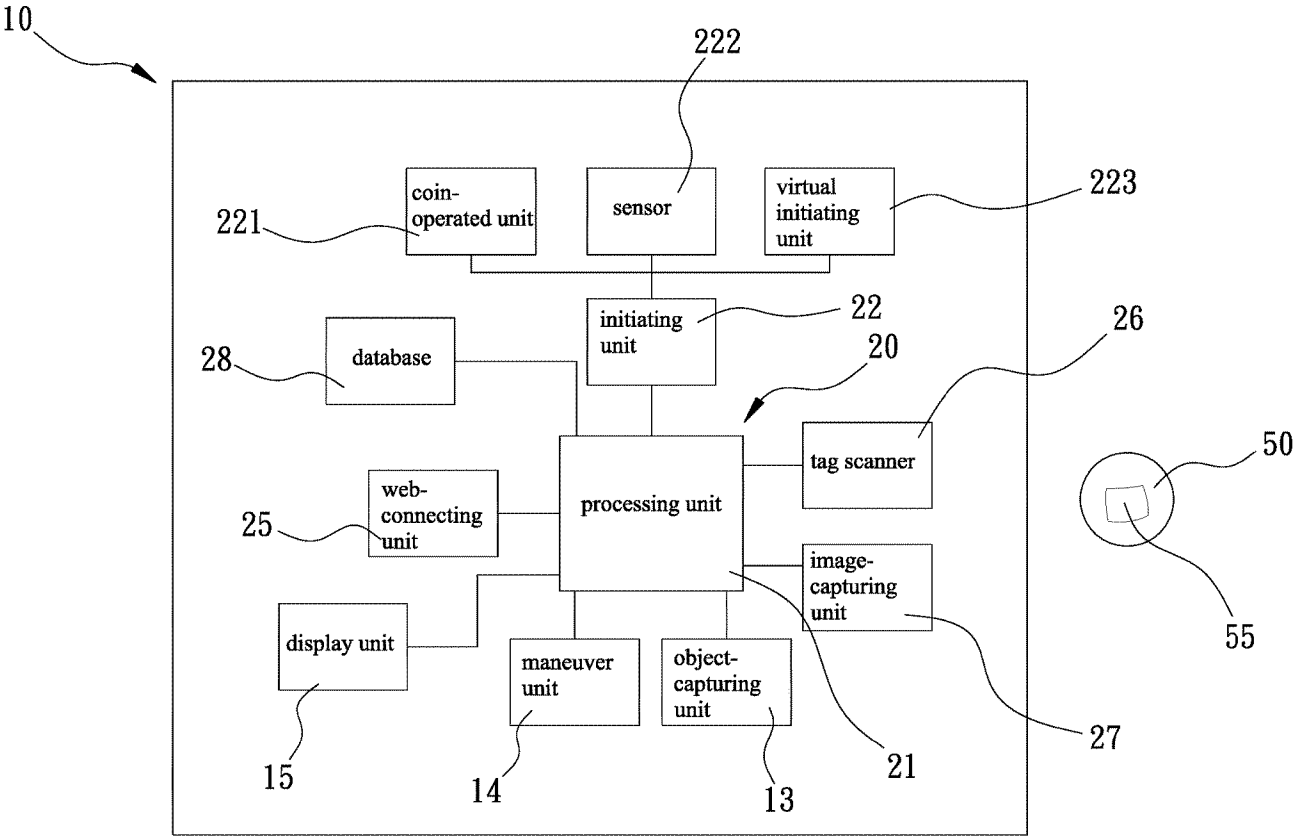
FIG. 2 is a block diagram of the multiply interactive game equipment shown in FIG. 1.
Figure 3:
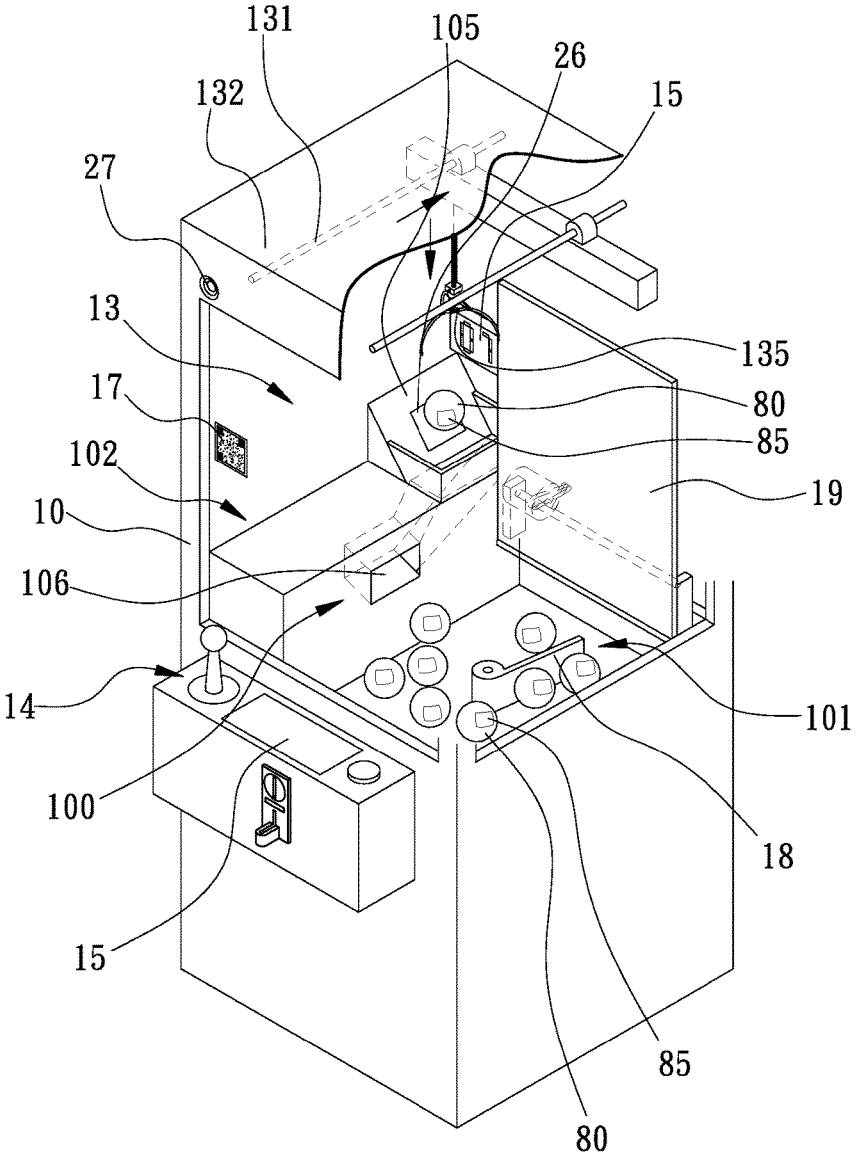
FIG. 3 is a perspective view of the multiply interactive game equipment shown in FIG. 1 in an operative mode.
Figure 4:
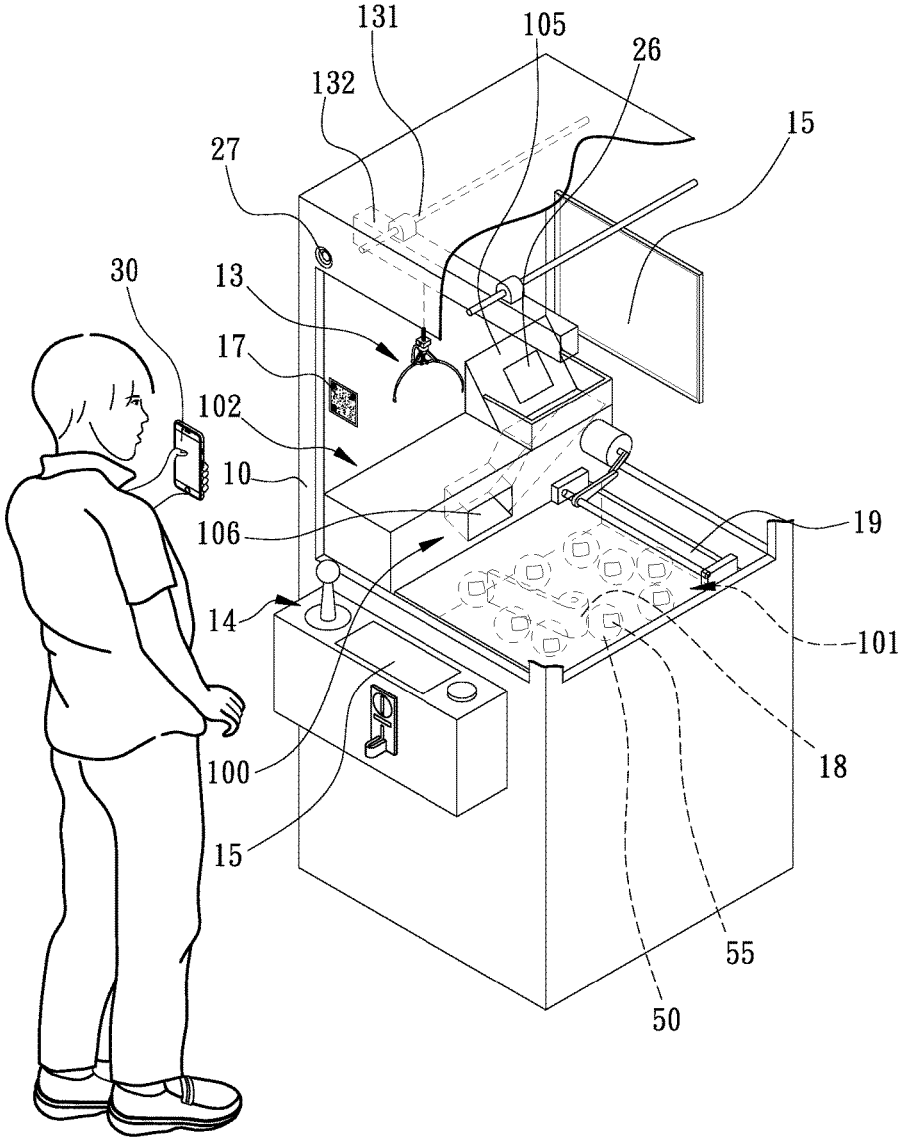
FIG. 4 is a perspective view of the multiply interactive game equipment in another operative mode than shown in FIG. 3.

Referring to FIGS. 1 and 2, multiply interactive game equipment includes a game machine 10 and a control module 20 according to the preferred embodiment the present invention. The game machine 10 is shaped like a telephone booth. The game machine 10 includes a space 100 for containing objects 50 in the form of balls or fluff dolls that can roll. In the preferred embodiment, each of the objects 50 is a ball that contains a product, a tag or a ticket for example. Each of the objects 50 is provided with an RFID tag 55. The RFID tags 55 are operated at 120 to 150 KHz. Each of the RFID tags 55 can be a passive, semi-passive or active RFID tag. Each of the RFID tags 55 is a read-only or read-and-write RFID tag. The RFID tags 55 can be scanned to provide numbers, alphabets, words or graphics.

The game machine includes an object-capturing unit 13, a maneuver unit 14, a display unit 15, an identification unit 17 and a stirrer 18. The object-capturing unit 13, the identification unit 17 and the stirrer 18 are inserted in the space 100. The maneuver unit 14 and the display unit 15 are supported on the game machine 10, out of the space 100.

The space 100 can be opened to allow the objects 50 to be inserted in or taken from the space 100. The space 100 can be closed to keep the objects 50 therein. The space 100 includes a capture area 101 and a scan area 102. The capture area 101 contains the objects 50. The scan area 102 includes a basket 105 and a chute 106. A lower end of the basket 105 is in communication with an upper end of the chute 106. A lower end of the chute 106 is in communication with the capture area 101. Thus, the objects 50 can fall into the capture area 101 from the scan area 102 via the chute 106.

The object-capturing unit 13 is inserted in an upper portion of the space 100. The object-capturing unit 13 can include a claw or a blower to drive the objects 50. The object-capturing unit 13 includes two tracks 131, a bar 132 and a claw 135 in the preferred embodiment. The tracks 131 extend parallel to each other and are provided in the upper portion of the space 100 of the game machine 10. A bar 132 is movably supported on the tracks 131. The claw 135 is connected to and dangles from the bar 132. The claw 135 is movable along the bar 132. Moreover, the claw 135 is movable up and down relative to the bar 132. For using the tracks 131 and the bar 132, the claw 135 is movable in the space 100 in a three-dimensional manner. The claw 135 can be opened and closed to capture a selected one of the objects 50. Thus, the claw 135 can carry the selected object 50 between the capture area 101 and the scan area 102.

The maneuver unit 14 is supported on the game machine 10 and operable to control the object-capturing unit 13 to capture a selected one of the objects 50. The maneuver unit 14 can include a joy stick and a button. The joy stick is operated to move the claw 135. The button is operated to close the claw 135. Alternatively, the maneuver unit 14 can include a touch panel that simulates a joy stick and a button. Alternatively, the maneuver unit 14 can include a portable device such as a smart phone. Preferably, the maneuver unit 14 includes a joy stick (not numbered) and a button (not numbered).

The display unit 15 is supported on the game machine 10, out of the space 100. The display unit 15 is preferably used for the maneuver unit 14. Thus, the status of maneuver with the maneuver unit 14 can be shown on the display unit 15. The display unit 15 can be used to show other data such as advertisement material.

The identification unit 17 is supported on the game machine 10. The identification unit 17 is used to carry the identity and location data of the game machine. The identification unit 17 can be a sticker printed with a barcode or an image of a barcode shown on the display unit 15.

The stirrer 18 is inserted in the capture area 101 of the space 100 of the game machine 10. The stirrer 18 can include a rotational rod, a shaking mechanism or a blower for stirring the objects 50. In the preferred embodiment, the stirrer 18 includes a rotational rod.

The cover 19 is located in the capture area 101 of the space 100. The cover 19 is used to keep the objects 50 from the stirrer 18 to increase effects entertainment.

The control module 20 is inserted in the space 100 of the game machine 10. The control module 20 includes a processing unit 21, an initiating unit 22, a web-connecting unit 25, a tag scanner 26 and an image-capturing unit 27. The processing unit 21 is electrically connected to the object-capturing unit 13, the maneuver unit 14, the display unit 15, the stirrer 18 and the cover 19. The processing unit 21 is used to process, send and receive commands.

The initiating unit 22 is electrically connected to the processing unit 21. The initiating unit 22 is a coin-operated unit 221 provided on the game machine 10. A player can insert at least one coin in the coin-operated unit 221 to start a round of game. Alternatively, the initiating unit 22 can be a sensor 222 provided on the game machine 10. A player can have a deposit card scan by the sensor 222 to start a round of game. Alternatively, the initiating unit 22 can be a virtual initiating unit 223 built in the processing unit 21. A player can has his- or herself identified by the virtual initiating unit 223 via a network such as the internet to start a round of game. The initiating unit 22 can be a combination of two or all of these elements.

The web-connecting unit 25 is used to communicate game data with the internet via cables or in a wireless manner.

The tag scanner 26 is located in the scan area 102 of the space 100 of the game machine 10. The tag scanner 26 is electrically connected to the processing unit 21. The tag scanner 26 is used to scan the RFID tags 55 of the objects 50. The data obtained by the tag scanner 26 are shown on the display unit 15. Preferably, the tag scanner 26 can be used to write in the RFID tags 55 of the objects 50.

The image-capturing unit 27 is supported on the game machine 10, out of the space 100. The image-capturing unit 27 is electrically connected to the processing unit 21. The image-capturing unit 27 is used to take images of the environment around the game machine 10 and players. The images of the players can be used for identification of the players.

The database 28 is located in the game machine 10. The database 28 is electrically connected to the processing unit 21. The database 28 is used to record game data and image data.

Referring to FIGS. 1 through 4, in operation, the objects 50, which include the RFID tags 55, are located in the capture area 101 of the space 100 of the game machine 10. The cover 19 covers the objects 50 in the capture area 101. The stirrer 18 is actuated to stir the objects 50 so that the player cannot know what are contained in the objects 50. The processing unit 21 of the control module 20 gives a command for a round of game such as finding a number for a certain prize, a number for use in bingo, a puzzle, a trademark or a slogan.

The game machine can be used as a stand-alone machine. In such a case, for payment, the player inserts a coin in coin-operated unit 221 of the initiating unit 22 or has a card scanned by the sensor 222 of the initiating unit 22. Thus, the player is allowed to operate the maneuver unit 14 to move the claw 135 of the object-capturing unit 13 to capture a selected one of the objects 50 in the capture area 101 of the space 100 via the processing unit 21. Holding an object 50, the claw 135 of the object-capturing unit 13 is operated to move the object 50 to the scan area 102 of the space 100 of the game machine 10. Thus, the tag scanner 26, which is located in the scan area 102, scans the RFID tag 55 of object 50. The processing unit 21 of the control module 20 translates the data scanned by the tag scanner 26 to numbers, alphabets, worlds or graphics that are shown on the display unit 15. The player can continue to capture other objects 50 if the game is used for bingo or a puzzle. The result, successful or failed, is used for marketing, claiming prizes or playing other games when the game is over. The effects of entertainment are improved.

Referring to FIG. 5, the game machine 10 can be used, alone or with other game machines 10, for on-line games that allow multiple players to play a round of game at a same time. The identification unit 17 and the web-connecting unit 25 are in communication of data with a portable device 30 such as a smart phone or a tablet computer of a player via the internet. To this end, an application program is installed in the portable device 30.

In the on-line mode, the objects 50 equipped with the RFID tags 55 are located in the capture area 101 of the space 100 of the game machine 10, concealed by the cover 19, and stirred by the stirrer 18. Thus, the player does not know what is in each of the objects 50. The processing unit 21 of the control module 20 can receive a command from a remote management server about a game such as bingo, a puzzle or another on-line game.

The player uses the portable device 30 to scan the identification unit 17 attached to the game machine 10 or shown on the display unit 15. The player uses the portable device 30 to connect to a remote management server via the internet. The remote server determines whether the game machine and the player are qualified. Then, the player uses the coin-operated unit 221 of the sensor 222 of the initiating unit 22 for payment. Alternatively, the player can use the portable device 30 to connect to the remote management server that in turn connects the virtual initiating unit 223 of the initiating unit 22 via the internet for on-line payment or free-of-charge rounds of game. Then, the player operates the maneuver unit 14 to move the claw 135 of the object-capturing unit 13 via the processing unit 21 to capture a selected one of the objects 50 in the capture area 101 of the space 100. After capturing an object 50, the claw 135 of the object-capturing unit 13 drops the object 50 into the scan area 102 of the space 100 of the game machine 10. The tag scanner 26 of the scan area 102 scans the RFID tag 55 of the object 50. The processing unit 21 of the control module 20 translates the RFID tag 55 to numbers, alphabets, words or graphics that are shown on the display unit 15. The player can continue to capture other objects 50 if the game is used for bingo or a puzzle. The result, successful or failed, is used for marketing, claiming prizes or playing other games when the game is over. The effects of entertainment are improved.

Moreover, the display unit 15 of the game machine 10 is operable to show advertisement or marketing materials for example from the database 28 of the processing unit 21 or from the management server via the web-connecting unit 25. The image-capturing unit 27 of the processing unit 21 studies the photograph of the player and the environment around the player to determine the sex and age of the player and people around the player, and accordingly shows a game mission, advertisement or marketing materials on the display unit 15 to satisfy needs of people around the game machine 10. The game machine 10 uses the web-connecting unit 25 of the processing unit 21 to send transaction data of the player and the identity data of the captured product 50 to the remote management server for management in the future.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims

The invention claimed is:

1. A multiply interactive game equipment comprising:

a game machine comprising:

a space comprising a capture area for containing objects each provided with an RFID tag and a scan area in communication with the capture area;

an object-capturing unit located in the space thereof;

a maneuver unit provided thereon and operable to control the object-capturing unit to capture one of the objects from the capture area and then drop the object into the scan area; and a display unit provided thereon; and a control module located in the game machine and comprising:

a processing unit electrically connected to the object-capturing unit, the maneuver unit and the display unit;

an initiating unit electrically connected to the processing unit;

a tag scanner located in the scan area of the game machine, electrically connected to the processing unit, and adapted for scanning the RFID tag of the object so that a code carried by the RFID tag of the object can be translated and shown on the display unit.

2. The multiply interactive game equipment according to claim 1, wherein the game machine further comprises:

a basket located in the scan area of the space; and a chute formed with an upper end in communication with the basket and a lower end in communication with the capture area so that the object dropped into the scan area falls back into the capture area via the chute.

3. The multiply interactive game equipment according to claim 1, wherein the game machine further comprises a stirrer located in the capture area of the space and adapted for stirring the objects.

4. The multiply interactive game equipment according to claim 3, wherein the game machine further comprises a cover located in the capture are of the space and adapted for covering the objects, which are stirred by the stirrer.

5. The multiply interactive game equipment according to claim 1, wherein the display unit comprises a touch panel for use with the maneuver unit and for showing the data from the tag scanner.

6. The multiply interactive game equipment according to claim 1, wherein the processing unit comprises a web-connecting unit adapted for connection to the internet via cables or in a wireless manner to communicate game data.

7. The multiply interactive game equipment according to claim 6, wherein the initiating unit comprises a virtual initiating unit built in the processing unit and adapted for receiving a command via the web-connecting unit and accordingly initiating a round of game.

8. The multiply interactive game equipment according to claim 6, wherein the processing unit comprises an image-capturing unit supported on the game machine and adapted for taking images of the environment around the game machine for identification.

9. The multiply interactive game equipment according to claim wherein 1, the game machine further comprises an identification unit for identifying the game machine.

10. The multiply interactive game equipment according to claim 1, wherein the RFID tag is a passive RFID tag operated at 120 to 150 KHz.

* * * * *